US007937028B2

(12) United States Patent
Ogawa et al.

(10) Patent No.: US 7,937,028 B2
(45) Date of Patent: May 3, 2011

(54) IMAGE FORMING APPARATUSES HAVING SPECIALIZED TONER STRUCTURES AND MATERIALS

(75) Inventors: Masato Ogawa, Kanagawa (JP); Tetsuya Fujioka, Kanagawa (JP); Takuji Takahashi, Kanagawa (JP); Takamasa Shiraki, Kanagawa (JP); Yoshihide Ohta, Kanagawa (JP); Kazushige Kawamura, Kanagawa (JP); Kohji Hatayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 64 days.

(21) Appl. No.: 12/458,253

(22) Filed: Jul. 7, 2009

(65) Prior Publication Data

US 2010/0021211 A1 Jan. 28, 2010

(30) Foreign Application Priority Data

Jul. 22, 2008 (JP) ..... 2008-189144

(51) Int. Cl.
*G03G 15/00* (2006.01)
*G03G 21/16* (2006.01)

(52) U.S. Cl. ..... 399/258; 399/107; 399/262

(58) Field of Classification Search ..... 399/107, 399/110, 118, 120, 262, 258
See application file for complete search history.

(56) References Cited

U.S. PATENT DOCUMENTS

| | | | | |
|---|---|---|---|---|
| 6,690,901 | B2 | 2/2004 | Katsuyama et al. | 399/107 |
| 7,174,121 | B2 | 2/2007 | Kuma et al. | 399/258 |
| 2006/0083555 | A1 * | 4/2006 | Uchiyama et al. | 399/258 |
| 2007/0071492 | A1 * | 3/2007 | Ito | 399/107 |
| 2008/0044199 | A1 * | 2/2008 | Marumoto | 399/107 |
| 2008/0181698 | A1 | 7/2008 | Andoh et al. | 399/405 |
| 2009/0110412 | A1 * | 4/2009 | Kakita | 399/27 |
| 2009/0218472 | A1 * | 9/2009 | Takemoto | 399/107 X |

FOREIGN PATENT DOCUMENTS

| | | |
|---|---|---|
| JP | 2001-206558 | 7/2001 |
| JP | 2002-023440 | 1/2002 |
| JP | 2006-229347 | 8/2006 |
| JP | 2007-135243 | 5/2007 |

* cited by examiner

*Primary Examiner* — Sophia S Chen
(74) *Attorney, Agent, or Firm* — Harness, Dickey & Pierce, P.L.C.

(57) ABSTRACT

Disclosed is an image forming apparatus including a toner feed unit used in a developing device and provided near a top surface of a body casing. The toner feed unit includes a frame that includes a toner container storage space portion including a curved concave portion formed of a material different from a material constituting the body casing, and has supporting surfaces, in a part of a top surface of the space, that support side portions of a device mounted on the body casing and a rear portion of the device connected to the side portions by surface contact. The frame has legs that extend from a position, which is located opposite to the device to be mounted, toward an installation surface of the body casing. The frame is built in the body casing.

16 Claims, 10 Drawing Sheets

IMAGE FORMING APPARATUSES HAVING SPECIALIZED TONER STRUCTURES AND MATERIALS

CROSS-REFERENCE TO RELATED APPLICATIONS

The present application claims priority to and incorporates by reference the entire contents of Japanese Patent Application No. 2008-189144 filed in Japan on Jul. 22, 2008.

BACKGROUND OF THE INVENTION

1. Field of the Invention

The present invention relates to an image forming apparatus. More particularly, the present invention relates to a supporting structure for a device when the device is mounted on a top surface of a body of an image forming apparatus.

2. Description of the Related Art

Image forming apparatuses such as copying machines, facsimile machines, printers, or other printing machines are configured so that electrostatic latent images formed on latent image carriers such as photoreceptors are subjected to visible image processing with a developing agent such as toner to form visible images that are then transferred and fixed onto a recording medium such as a sheet, whereby copy output can be obtained.

Sometimes an image reading device is mounted on the upper part of a body of an image forming apparatus as disclosed, for example, in Japanese Patent Laid-open Publication No. 2006-229347.

In the conventional technique disclosed in Japanese Patent Laid-open Publication No. 2006-229347 the image reading device is mounted on a casing of the image forming apparatus. Specifically, a strut portion is mounted on both side plates of the casing. Each of the strut portions is fixed to the casing by fastening or the like. Thereafter, legs of the image reading device are loaded into a fitting portion provided in the strut portions. As a result, the image reading device is supported in a cantilever beam state.

In another conventional technique disclosed in Japanese Patent Laid-open Publication No. 2007-135243 and Japanese Patent Laid-open Publication No. 2002-23440), a mounting base for mounting an image reading device is provided on opposed peripheral portions on a rectangular plane constituting a top surface of a casing of the image forming apparatus. Moreover, an adjustment member, the height of which can be adjusted, for ensuring the flatness of the mounting surface, is provided on the mounting base.

In another conventional technique disclosed in Japanese Patent Laid-open Publication No. 2001-206558, unlike the above-mentioned conventional techniques, a dedicated mounting device is provided near an image forming apparatus to mount an image reading device. In other words, the image reading device is not mounted on a casing of the image forming apparatus.

The configuration in which the image forming apparatus is mounted on the casing of the image forming apparatus is advantageous; because, unlike the configuration disclosed in Japanese Patent Laid-open Publication No. 2001-206558, no dedicated equipment is not required.

When the casing is made by resin molding, an image reading device, which is a heavy object, cannot be directly mounted on the casing. Therefore, as disclosed in Japanese Patent Laid-open Publication No. 2006-229347, strut portions or the need to be provided to bear the weight of the image reading device.

However, in order to provide the strut portions and the like, the structure of the casing of the image forming apparatus needs to be changed. Accordingly, the act of changing the structure leads to an increase in the manufacturing costs.

Further, it should be noted that the strut portions are necessary when mounting the image reading device. Therefore, a difference in details of assembling of the body casing occurs between when the image reading device is mounted and when the image reading device is not mounted, making it impossible to render components management cost and process cost uniform regardless of whether the image reading device is mounted.

In still another convention technique disclosed in Japanese Patent Laid-open Publication No. 2006-229347, the image reading device is provided above a toner feed unit in a developing device. In this configuration, when replacing a bottle in the toner feed unit, the image reading device must be first evacuated from the mounting position. Therefore, in the image reading device, which is mounted so as to be openable and closable on the top surface of the casing, since the opening/closing supporting points are the strut portions, from the viewpoint of enhancing the rigidity, the image reading device should have a large size that can withstand a considerably high level of load. Thus, the areas occupied by the supporting portion of the image reading device on the top surface of the casing are increased, leading to a possibility of an increase in size of the structure and an increase in weight of the structure. Further, in order to prevent shifting of image forming positions caused, for example, by misregistration of the image forming device supported by the body casing, it is important that the application of load from the mounted device to the body casing as an existing structure be prevented by the strut portions.

SUMMARY OF THE INVENTION

It is an object of the present invention to at least partially solve the problems in the conventional technology.

According to an aspect of the present invention there is provided an image forming apparatus including a toner feed unit that feeds toner to a developing device in the image forming apparatus and arranged inside and near a top surface of a body casing of the image forming apparatus. The toner feed unit including a toner container configured to house therein toner; and a frame configured to hold the toner container. The frame including a toner-container storage portion having a curved concave portion to hold the toner container, the toner-container storage portion being formed of a material different from a material of the body casing; and a supporting surface that supports plural portions of a mounting target device that is configured to be mounted above the toner-container storage portion by surface contact.

According to another aspect of the present invention there is provided an image forming apparatus including a toner feed unit that feeds toner to a developing device in the image forming apparatus and arranged inside and near a top surface of a body casing of the image forming apparatus. The toner feed unit including a toner container configured to house therein toner; and a frame configured to hold the toner container. The frame including a toner-container storage portion having a curved concave portion to hold the toner container, the toner-container storage portion being formed of a material different from a material of the body casing; and a supporting surface that supports three points of a mounting target device that is configured to be mounted above the toner-container storage portion by surface contact.

According to still another aspect of the present invention there is provided an image forming apparatus including a toner feed means for feeding toner to a developing device in the image forming apparatus and arranged inside and near a top surface of a body casing of the image forming apparatus. The toner feed means including a toner container means configured to house therein toner; and a frame means configured to hold the toner container means. The frame means including a toner-container storage means having a curved concave portion to hold the toner container means, the toner-container storage means being formed of a material different from a material of the body casing; and a supporting surface means that supports plural portions of a mounting target device that is configured to be mounted above the toner-container storage means by surface contact.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained with reference to the accompanying drawings.

Figure 1:
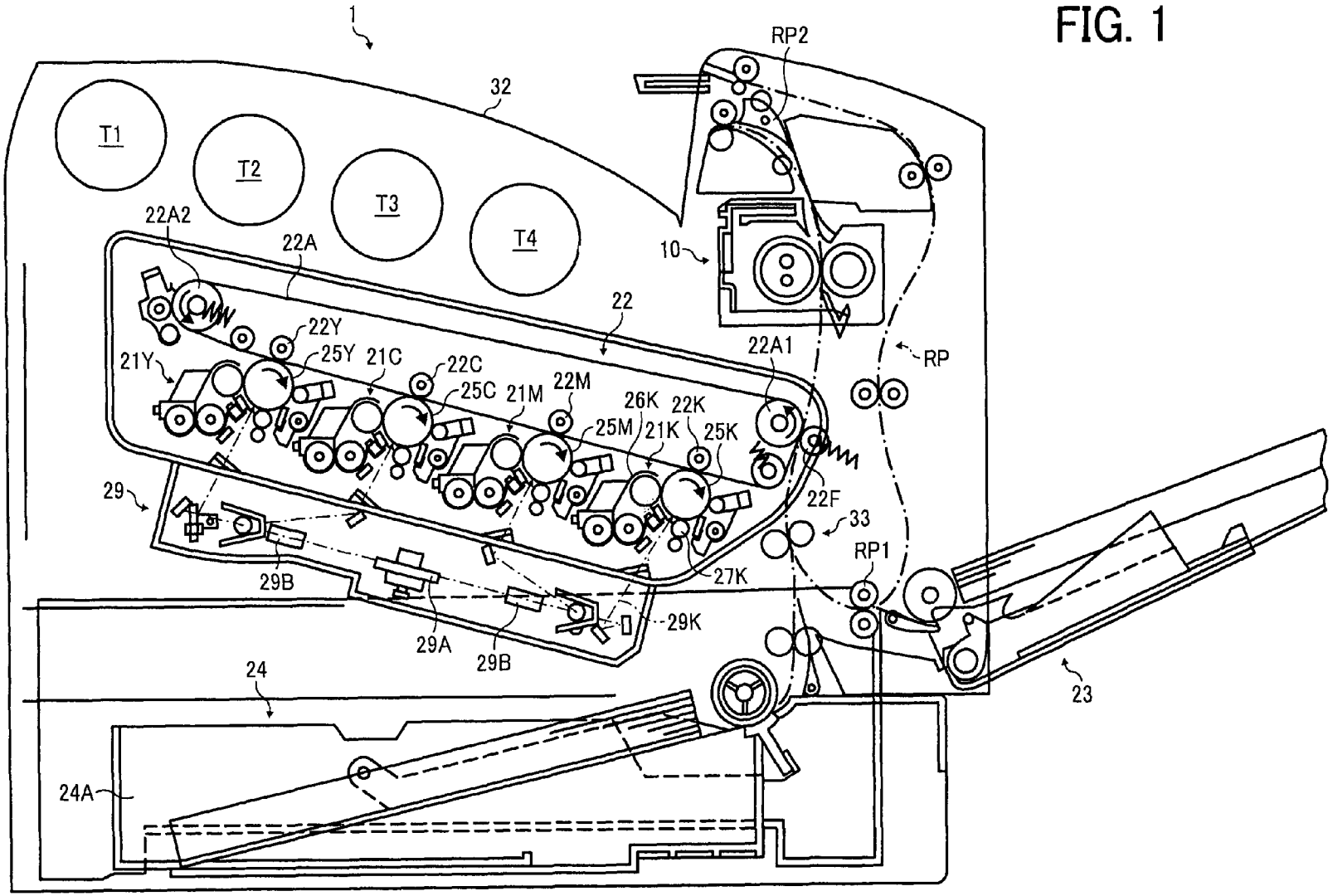
FIG. 1 is a schematic diagram for explaining an internal configuration of an image forming apparatus according to an embodiment of the present invention.

FIG. 1 is a schematic diagram for explaining an internal configuration of an image forming apparatus 1 according to the present invention, particularly an internal configuration including a toner feed unit provided on an upper part of a body casing. The image forming apparatus 1 is a color printer that can form a full color image by adopting a tandem system. The image forming apparatus is not necessarily limited to a color printer. In other words, the image forming apparatus can be a copying machine, a facsimile machine, or a printing machine.

In FIG. 1, an image forming apparatus 1 includes the following devices.

Specifically, devices provided in the image forming apparatus 1 include image creating devices 21Y, 21C, 21M, and 21K that form respective color images according to an original image, a transfer device 22 disposed opposite to the image creating devices 21Y, 21C, 21M, and 21K, a manual feed tray 23 and a sheet cassette 24A mounted in a sheet feeder 24, the manual feed tray 23 and the sheet cassette 24A functioning as a sheet feed unit that feeds a recording sheet into a transfer region where the image creating devices 21Y, 21C, 21M, and 21K and the transfer device 22 are located opposite to each other, a pair of registration rollers 33 that feeds the recording sheet conveyed from the manual feed tray 23 or the sheet cassette 24A in accordance with the timing of image creation by the image creating devices 21Y, 21C, 21M, and 21K, and a fixing device 10 that fixes the sheet-shaped medium subjected to transfer in the transfer region.

The fixing device 10 uses a thermal roller fixing system. The detailed explanation of the thermal roller fixing system will be omitted, but the thermal roller fixing system is a system in which an image is fixed to a recording sheet through a melting and softening step and a penetrating step by the action of heat and pressure using a heating roller and a pressure roller that are provided opposite to each other and can be abutted against each other with a recording sheet conveying path provided therebetween.

The transfer device 22 includes a belt 22A as a transfer medium (hereinafter referred to as "transfer belt") that is stretched around a plurality of rollers 22A1 and 22A2. Transfer bias units 22Y, 22C, 22M, and 22K, which apply a transfer bias, are disposed at positions opposite to photoreceptor drums in the respective image creating devices. The transfer device 22 is configured so that toner images formed in the respective image creating devices are successively superimposed and transferred by applying a transfer bias having a reverse polarity to the toner.

In the transfer device 22, a secondary transfer bias unit 22F, which simultaneously transfers the toner images superimposed and transferred onto the transfer belt 22A to the recording sheet, is provided on a recording sheet conveying path.

The image forming apparatus 1 can use as recording sheets any of plain papers generally used, for example, in copying, or the so-called special sheets having a larger heat capacity than sheets, for example, OHP transparency, 90 K papers such as cards and postcards, thick papers corresponding to a basis weight equal to or more than about 100 g/m$^2$, or envelopes.

The image creating devices 21Y, 21C, 21M, and 21K perform the development of a yellow color, the development of a cyan color, the development of a magenta color, and the development of a black color, respectively. The configuration of the image creating devices 21Y, 21C, 21M, and 21K is identical except the colors of the toners. Accordingly, the configuration of the image creating device 21K will be explained as a typical example of the image creating devices 21Y, 21C, 21M, and 21K.

The image creating device 21K includes a photoreceptor drum 25K as an electrostatic latent image carrier, and a charging device 27K, a developing device 26K, and a cleaning device that are arranged in that order along the direction of rotation of the photoreceptor drum 25K. In the image creating device 21K, an electrostatic latent image according to image information corresponding to colors separated from each other by a writing light 29K from a writing device 29 is formed between the charging device 27K and the developing device 26K. The electrostatic latent image carrier may be in the form of a drum or alternatively may be in the form of a belt. The devices for image formation, in other words, for image creation, arranged around the photoreceptor drums are housed all in a process cartridge (not shown) having a unit structure provided with a casing shown in FIG. 2.

The transfer device 22 is extended obliquely. Accordingly, the space necessary for the transfer device 22 in a horizontal direction can be reduced.

The image forming apparatus 1 performs image formation in the manner explained below. The formation of an image will be explained by taking the image creating device, which forms an image using a black toner, indicated by a reference character 21K, as a typical example of the image creating devices. However, it should be noted that the following explanation is true of the other image creating devices.

At the time of image formation, the photoreceptor drum 25K is rotation driven by a main motor (not shown). An AC (alternating current) bias (DC-(direct current) component being zero) is applied to the charging device 27K to remove electricity, and the surface potential is set to a reference potential of about −50 V.

Next, the photoreceptor drum 25K is uniformly charged at a potential substantially equal to a DC component by applying a DC bias with an AC bias superimposed thereon to the charging device 27K, whereby the surface potential is charged to about −500 Volts to −700 Volts. It should be noted that a target charge potential is determined by a process control unit.

When the photoreceptor drum 25K has been uniformly charged, a writing process is performed. An image as an object to be written is written with the writing device 29 according to digital image information delivered from a controller unit (not shown) to form an electrostatic latent image. That is, in the writing device 29, a laser beam emitted from a laser light source based on a laser diode emission signal binarized for each color according to digital image information is applied through a cylindrical lens (not shown), a polygon motor 29A, a fθ lens 29B, a first mirror to a third mirror, and a WTL lens onto a corresponding one of the photoreceptor drums bearing respective color images, i.e., the photoreceptor drum 25K in this case. The surface potential of the photoreceptor drum 25K in its exposed areas becomes about −50 V, and an electrostatic latent image corresponding to the image information is created.

The electrostatic latent image formed on the photoreceptor drum 25K is subjected to visible image processing with the developing device 26K using a toner having a color complementary to a separated color. In the developing process, when DC: −300 Volts to −500 Volts with an AC bias superimposed thereon is applied to a developing sleeve, the toner (Q/M: −20 μC/g to −30 μC/g) is developed only in the image portion of which the potential is lowered by the writing light irradiation to form a toner image.

The toner image for each color subjected to the visible image processing by the developing process is transferred onto a recording sheet delivered at preset registration timing by the registration rollers 33.

The toner images are electrostatically transferred from the respective photoreceptor drums onto the transfer belt 22A by applying a bias having a reverse polarity to the toner by each of the transfer bias units 22Y, 22C, 22M, and 22K provided in the transfer device 22 at positions opposite to the photoreceptor drums 25Y, 25C, 25M, and 25K in the respective image creating devices. The superimposed and transferred toner images are simultaneously transferred by the secondary transfer bias unit 22F onto the recording sheet.

The recording sheet subjected to transfer steps for respective colors is separated from the transfer belt 22A by curvature separation with a drive-side roller (indicated by a reference character 22A1 in FIG. 1 for convenience) in a transfer belt unit and is conveyed toward the fixing device 10. In the fixing device 10, when the recording sheet is passed through a fixing nip formed by a fixing belt and a pressure roller, the toner images are fixed onto the recording sheet. The recording sheet is then delivered to a catch tray 32.

Image formation can be performed on one side of the recording sheet delivered after the fixation, as well as on both sides of the recording sheet. When image formation is to be performed on both sides of the recording sheet, the recording sheet after the fixation is conveyed to a reverse circulation path RP and is delivered toward the registration rollers 33 by a pair of delivery rollers RP1 that is located at the end of the circulation path and also functions to deliver a sheet from the manual feed tray 23. Switching between the recording sheet conveying path in the image formation on one side of the recording sheet and the recording sheet conveying path in the image formation on both sides of the recording sheet is performed by a conveying path switching pawl RP2 provided in the rear of the fixing device 10.

The image forming apparatus 1 includes a toner feed unit including toner feed bottles (hereinafter referred to as "toner bottles" for convenience) T1, T2, T3, and T4, which are toner containers containing respective color toners in order to newly feed toners to the developing devices that perform visible image processing for respective colors. The toner feed unit is provided through feed paths (not shown) in communication with the respective developing devices, such as developing device 26K of image creating device 21K.

The toner feed unit is characterized by a supporting structure for the toner bottles, and the characteristic configuration will be explained.

Figure 2:
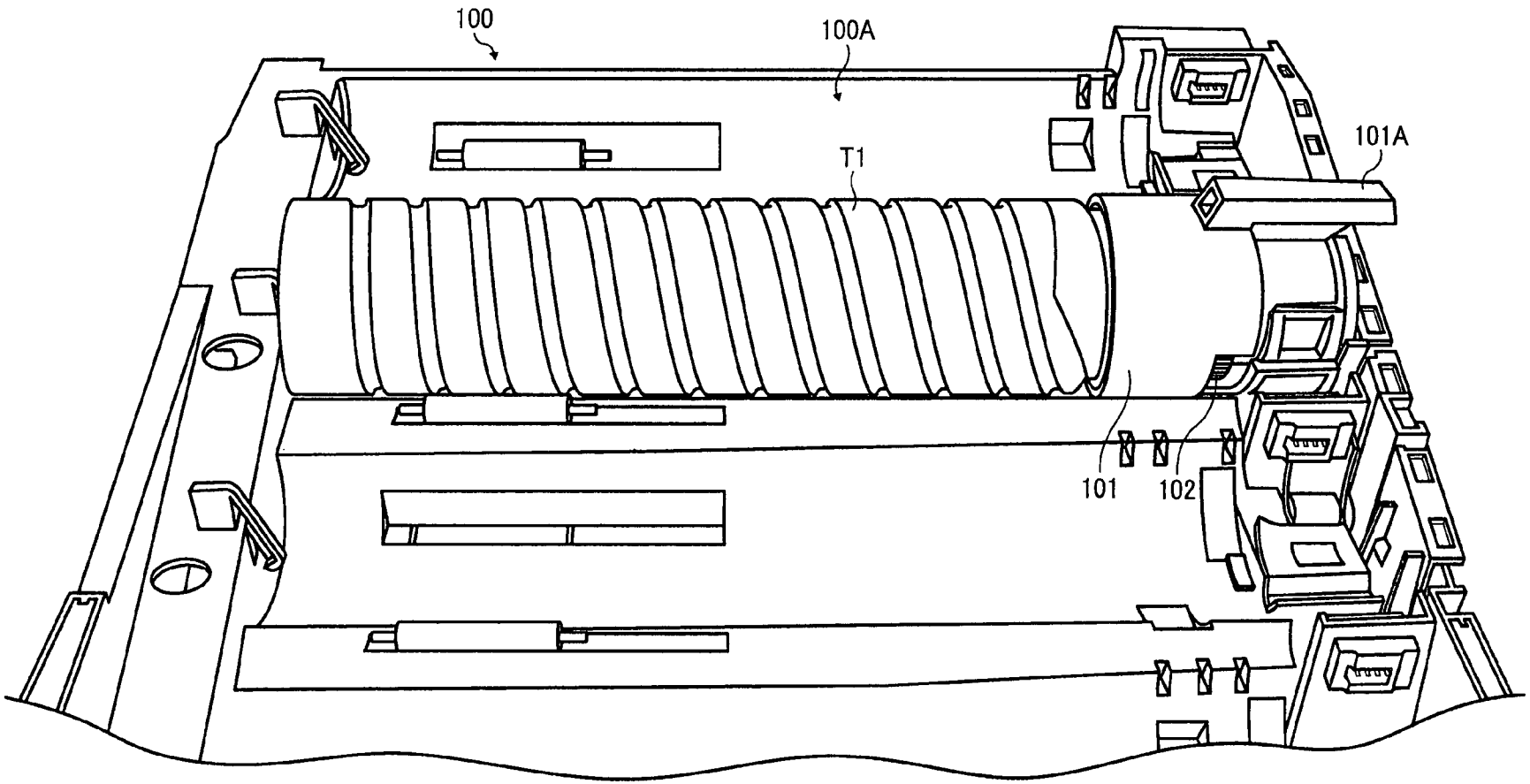
FIG. 2 is a perspective view of a configuration of a toner feed unit used in the image forming apparatus shown in FIG. 1.

FIG. 2 is an external view for explaining an installed state of a toner bottle (indicated by a reference character T1 for convenience) in the toner feed unit. The toner bottle T1 is mounted within a toner container storage space portion (hereinafter referred to as "storage space" for convenience) 100A provided in a mounting member 100 constituting the toner feed unit.

The storage space 100A is open at the top thereof and is configured so that the toner bottle T1 can be inserted thereinto from a direction orthogonal to the longitudinal direction of the storage space 100A, that is, can be inserted from above in FIG. 2.

A handle ring member 101 is mounted around the circumferential surface of one end in the longitudinal direction of the toner bottle T1. A gripper 101A is provided, outside the handle ring member 101, integrally with the handle ring member 101. The gripper 101A is gripped when the toner bottle T1 is detached or attached from the image forming apparatus 1.

A driven gear 102, which engages with a drive gear provided in a drive source (not shown), is provided integrally with the end of the toner bottle T1.

Characteristic features of the present embodiment will be explained by taking a configuration comprising the toner feed unit provided on the upper part of the body casing as an object.

Figure 3:
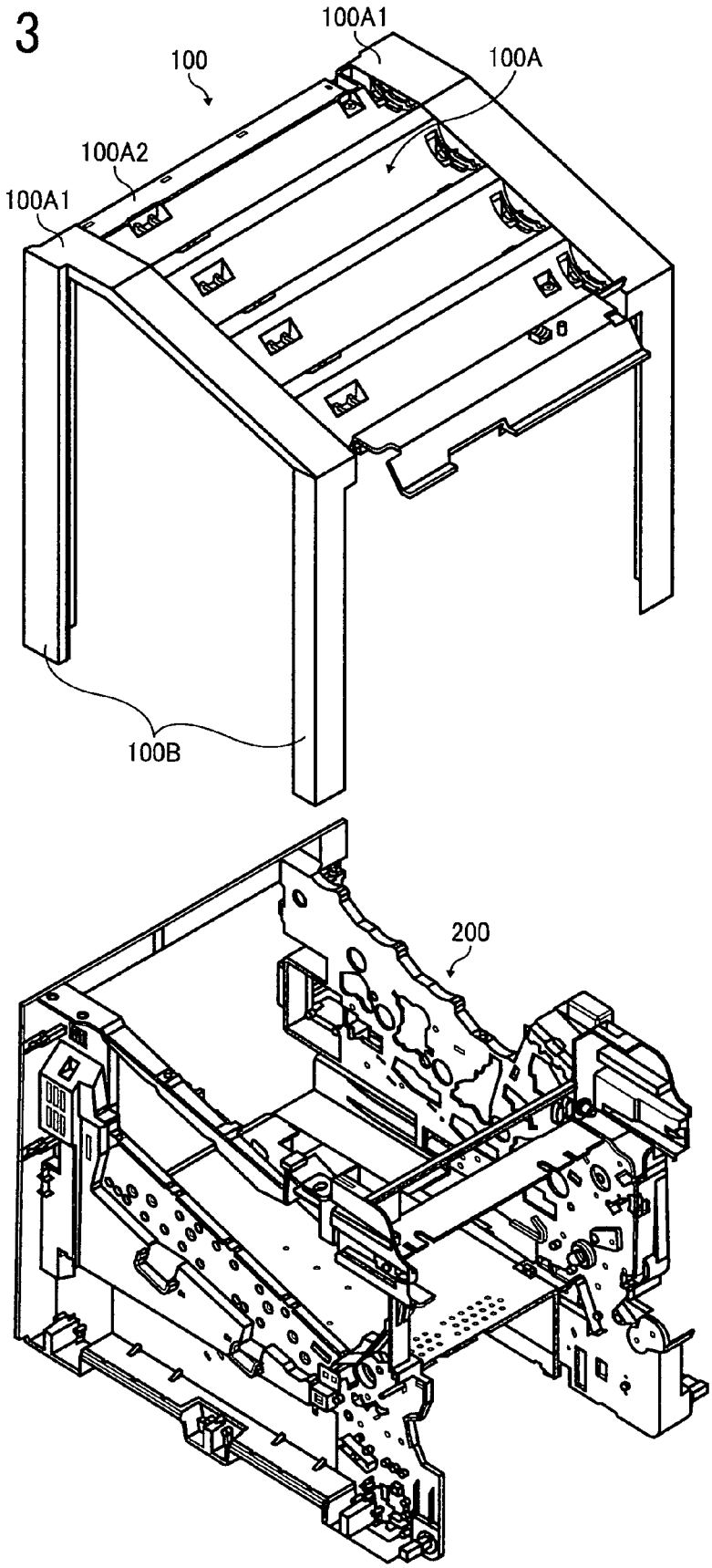
FIG. 3 depicts perspective views of a configuration of principal portions of the image forming apparatus shown in FIG. 1.

FIG. 3 is a perspective view of a frame of the mounting member 100 of the toner feed unit. The frame is formed of a material different from the material constituting a body casing 200. A curved surface formed of a concave portion, which is a shape into which the toner bottle is loaded, is formed at a position corresponding to the toner bottle storage space 100A.

The mounting member (hereinafter referred to also as "frame" for convenience) 100 has side portions 100A1 of both sides in the longitudinal direction of the toner bottle loaded into the storage space 100A and a rear portion 100A2 connecting the side portions 100A1. The side portions 100A1 and the rear portion 100A2 have a flat surface and constitute a supporting surface of an image reading device 300 (see FIG. 4). Hereinafter, the supporting surface will be indicated by reference characters 100A1 and 100A2 for convenience.

Figure 4:
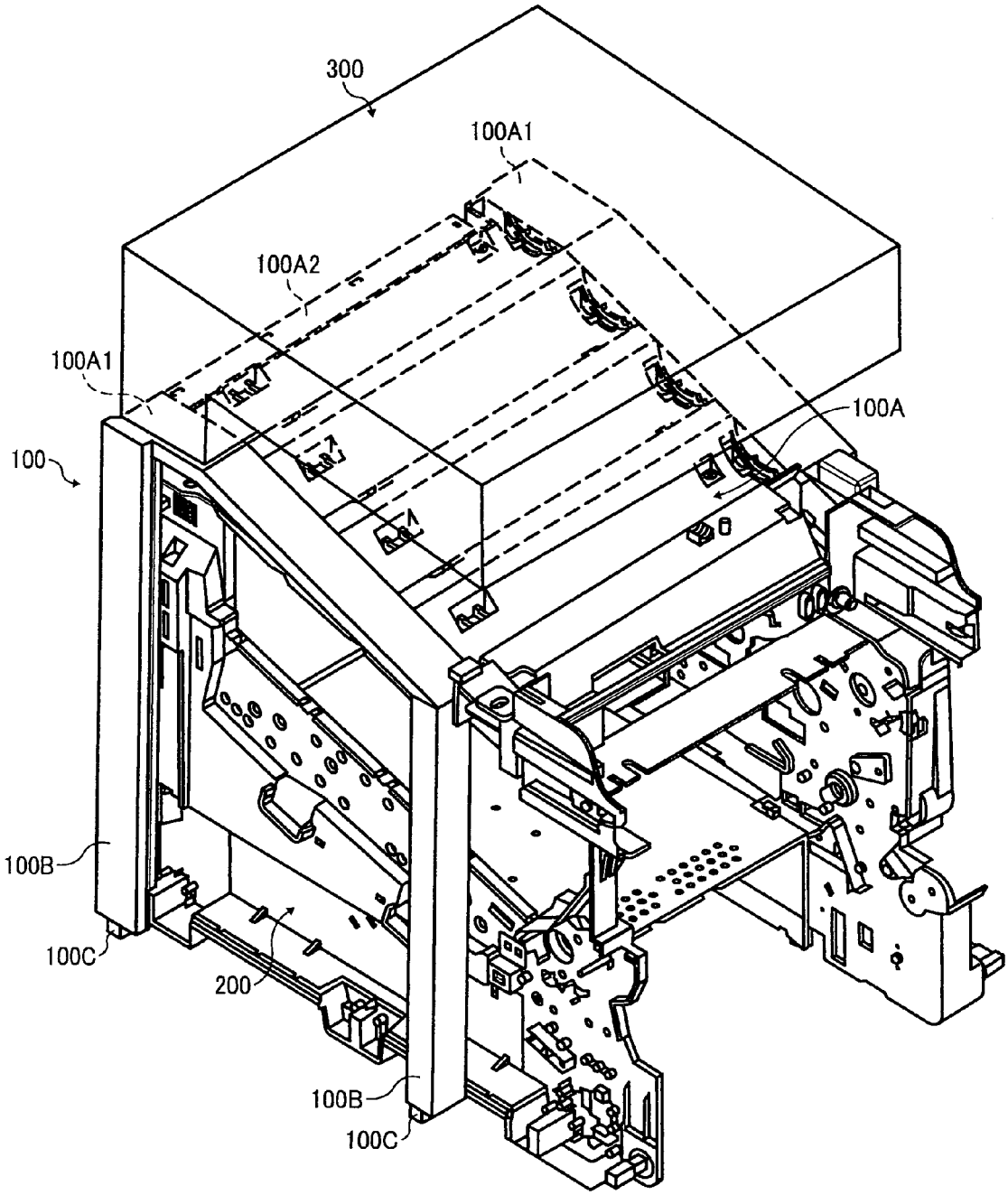
FIG. 4 is a perspective view of an assembled state from the dismantled state shown in FIG. 3.

The mounting member 100 includes legs 100B at four corners of a surface opposite to the toner bottle mounting surface in the storage space 100A. The legs 100B extend downward in FIG. 3, that is, from the positions of the supporting surfaces 100A1, 100A2 opposite to the image reading device 300 as the mounting object toward an installation surface (for example, a floor surface) of the body casing 200 as shown in FIG. 4.

The legs 100B have a length defined by a distance from the positions of the supporting surfaces 100A1, 100A2 to the installation surface. An elastic body 100C (see FIG. 4) such as rubber is provided on the installation surface so that impact and load applied when the image reading device 300 is mounted can be absorbed by elastic deformation of the elastic body 100C.

The legs 100B are made of a sheet metal and are provided integrally with the supporting surfaces 100A1, 100A2. As shown in FIG. 4, when the image reading device 300 is loaded on the supporting surfaces 100A1, 100A2, the legs 100B can withstand the weight of the image reading device 300. In particular, the mounting member 100 has a vertically curved toner bottle mounting surface and thus it has a high rigidity in the vertical direction.

Thus, the weight load applied when the image reading device 300 is mounted acts directly on the mounting member 100. The weight load can be supported by the structural shape of the mounting member 100 and does not act directly on the body casing 200 in which the mounting member 100 is incorporated. Consequently, the image reading device 300 can be supported while suppressing mechanical deformation of the body casing 200.

When the image reading device 300 is mounted on the mounting member 100, the image reading device 300 is supported by a three-point supporting structure using three supporting surfaces 100A1, 100A2 provided on both side portions and a rear portion connecting the both side portions to each other. Accordingly, the image reading device 300 can be mounted in a stabile manner. Further, local load concentration in the mounting member 100 can be suppressed, and, by virtue of the configuration in cooperation with the sectional structure, the strength of the mounting member 100 per se can be maintained.

In particular, in the body casing 200 in which the mounting member 100 is incorporated, load applied to both side portions can be equalized by taking advantage of dispersion of the load to the supporting surfaces 100A1, 100A2. Thus, for example, twisting of the body casing caused when unequal load concentration has occurred on both side portions can be reliably prevented.

Figure 5:
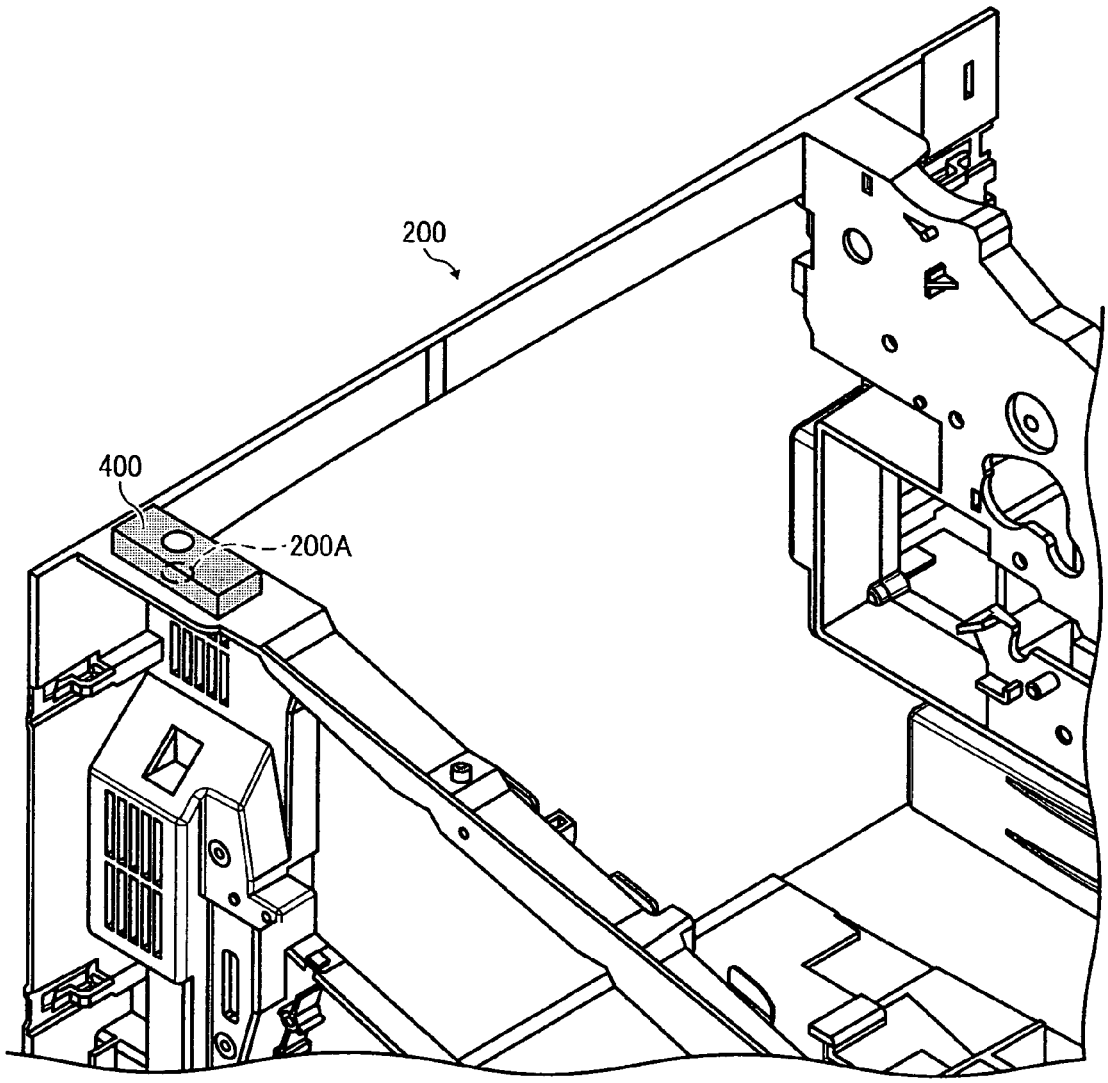
FIG. 5 is a partial perspective view of a part of a body casing in the configuration of the principal portion shown in FIG. 3.
Figure 6:
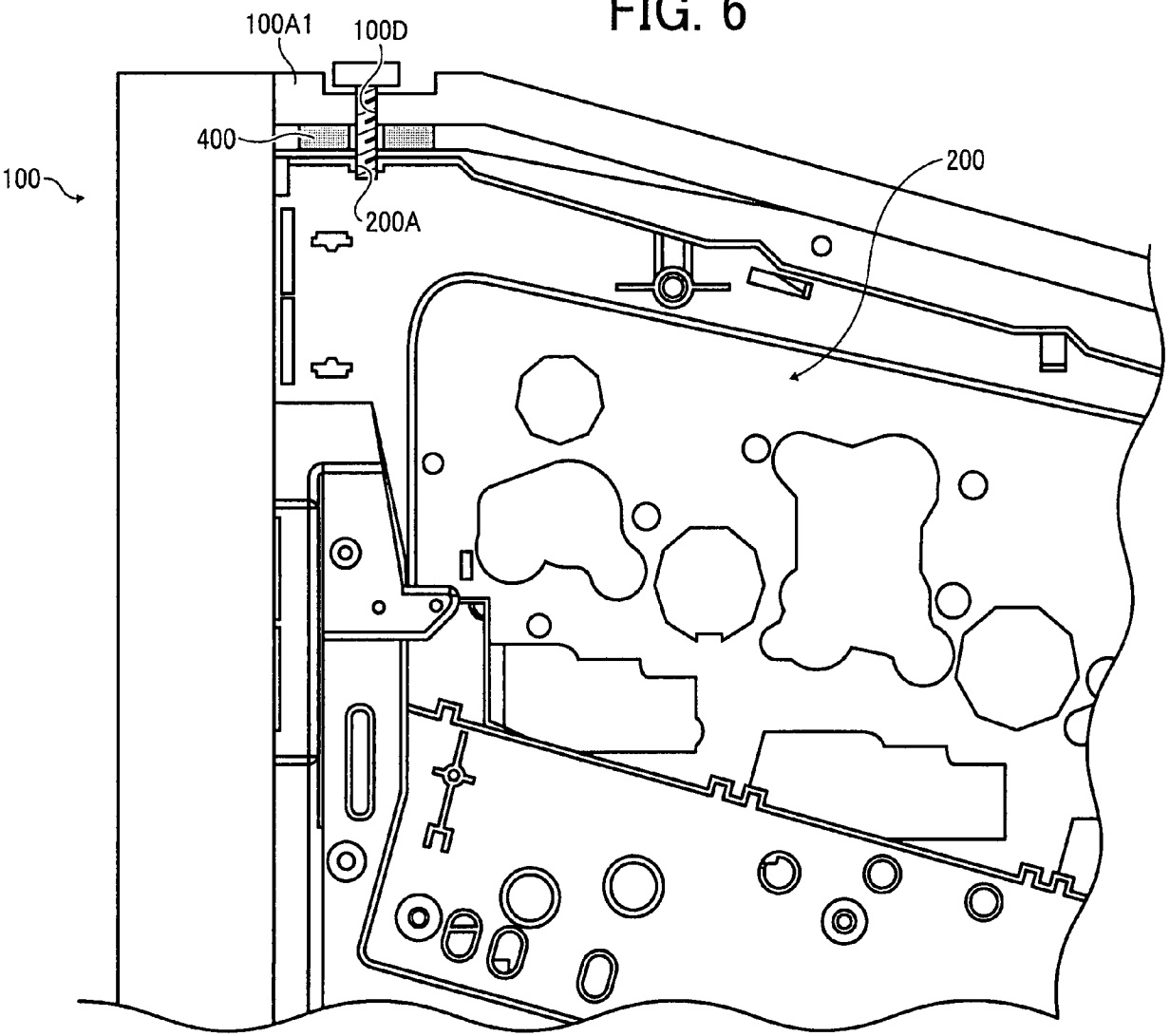
FIG. 6 is a diagram for explaining an assembled state between a body casing in the configuration of the principal portion shown in FIG. 3 and a mounting member constituting a principal portion of a toner feed unit.

The built-in configuration of the mounting member 100 and the body casing 200 is as shown in FIGS. 5 and 6. That is, mounting holes 100D, 200A for fastening the mounting member 100 are provided on a part of opposed positions in the mounting member 100 and the body casing 200. A cushioning material 400 is provided so as to cover the mounting hole 100D.

Rubber or sponge and the like can be used as the cushioning material 400 and is applied to the body casing 200 side. The provision of the cushioning material 400 at the fastening position can cushion load and impact, caused in a mounted state, by elastic deformation, and the application of the load directly to the body casing 200 can be prevented.

Therefore, the application of load directly to the body casing 200 can be avoided. Further, by virtue of dispersion of load by the provision of the supporting surfaces 100A1, 100A2, twist deformation, which is likely to occur in the body casing, can be reliably prevented. Consequently, misregistration between image forming portions caused by such deformation can be prevented, and, thus, color shifting caused by the misregistration can be reliably prevented.

In particular, the mounting member 100 is not a member not related to the body casing 200 but is a member indispensable to the toner feed unit. Although the mounting member 100 is an existing structure, mere utilization of the structure can eliminate an adverse effect of an increase in load to the body casing without the need to change the structure of the body casing.

Next, another embodiment of the present invention will be explained. The characteristic feature of this embodiment lies in the positioning of an image reading device when the image reading device is mounted on the mounting member 100.

Figure 7:
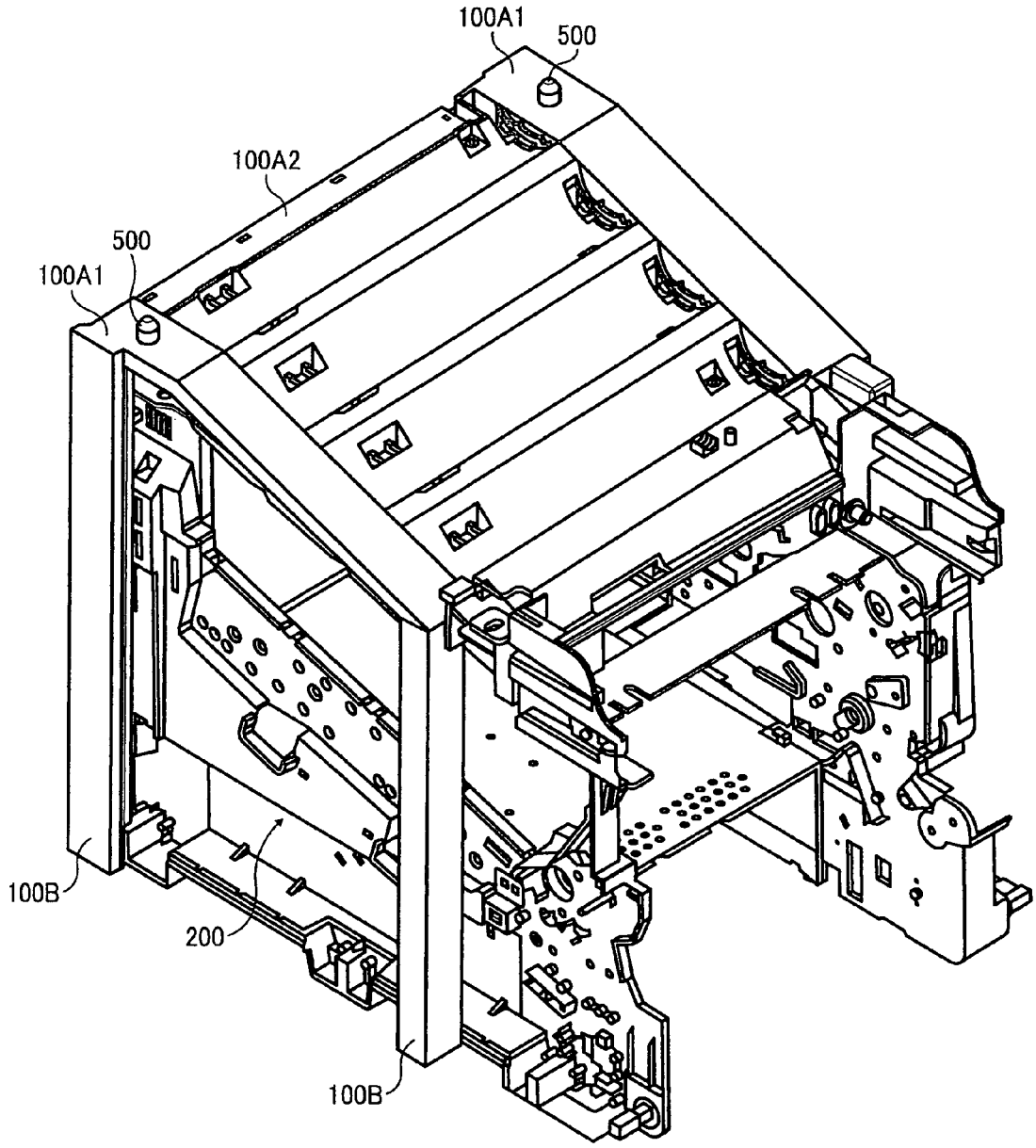
FIG. 7 is a perspective view of a top surface of a mounting member in the configuration of the principal portion shown in FIG. 3.

FIG. 7 is a diagram for explaining a configuration of the embodiment. As shown in FIG. 7, an upward protrusion 500 is provided on a part of each of the supporting surfaces 100A1, 100A2 in the mounting member 100. Particularly, as shown in FIG. 7, the upward protrusions 500 are provided on the upper surface on the supporting surface 100A1 side.

Positioning of the image reading device 300, when the image reading device 300 is mounted, can be performed by fitting the protrusions 500 into fitting portions (not shown) provided on the side of the image reading device 300. In particular, the protrusions 500 can be used as an indicator of position in mounting the image reading device 300 by afterward addition. Thus, the workability of mounting the image reading device 300 can be improved.

Figure 8:
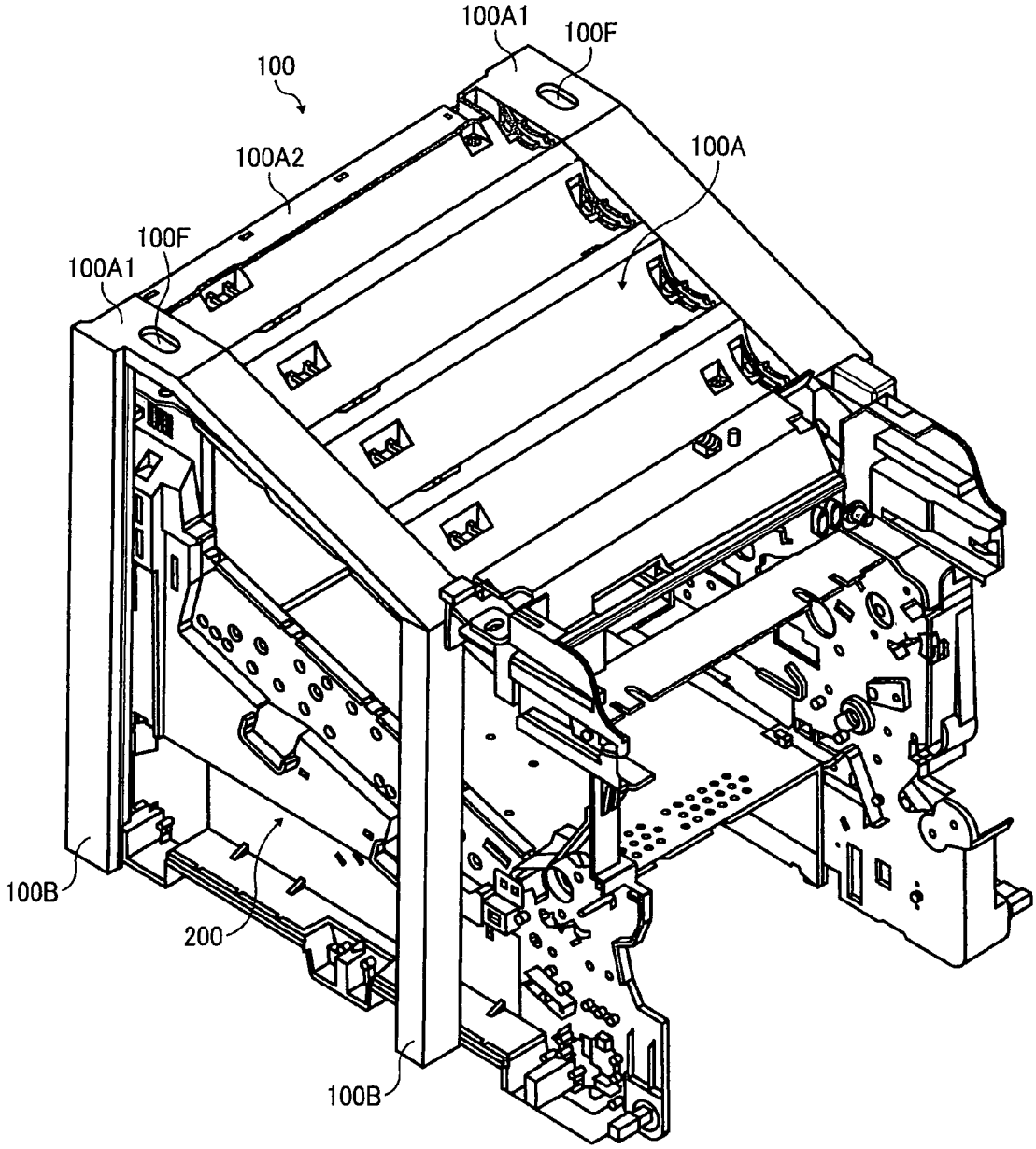
FIG. 8 is a perspective view of another configuration of a top surface of the mounting member shown in FIG. 7.

FIG. 8 is a diagram for explaining a positioning structure when convex portions are provided on the image reading device 300 side. In FIG. 8, holes 100F, into which protrusions provided on the bottom of the image reading device 300 side can be fitted, are provided on a part of the supporting surfaces 100A1, 100A2 of the mounting member 100. In this case, legs may be used as one of possible protrusions on the image reading device 300 side.

Figure 9:
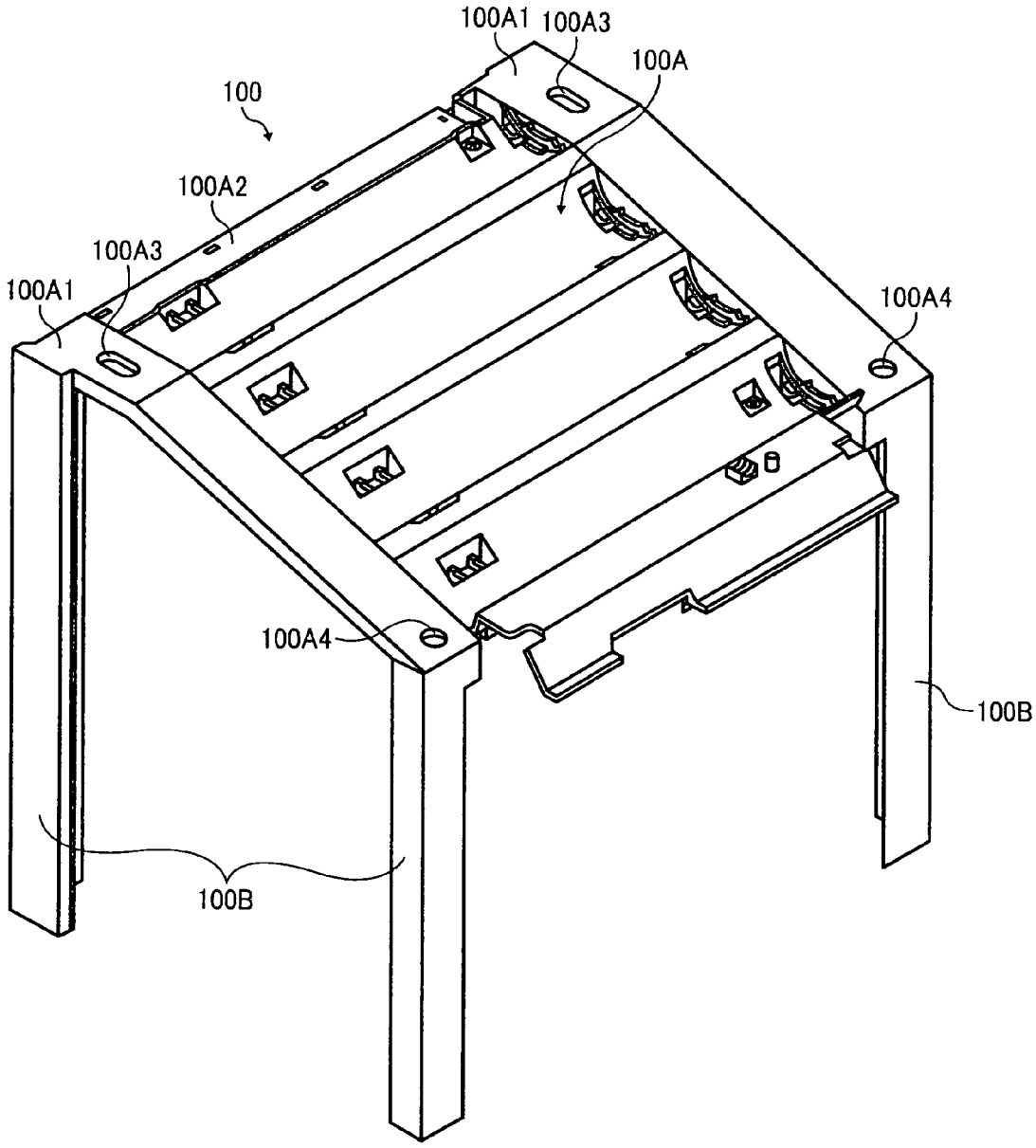
FIG. 9 is a perspective view of still another configuration of a top surface of the mounting member shown in FIG. 7.

FIG. 9 is a diagram for explaining a configuration that can realize a fine adjustment in positioning of the image reading device 300. As shown in FIG. 9, long holes 100A3 having a longitudinal direction horizontal to a back and forth direction (a direction indicated by an arrow in the drawing) of the body casing 200 are provided in one supporting surface 100A1 on the top surface of the mounting member 100. Reference holes 100A4, which are round in shape, are provided on a top surface of the mounting member 100 corresponding to one side of the longitudinal direction of the long hole 100A3, that is, a top surface of the mounting member 100 on the front side of the body casing 200 in FIG. 9.

The long holes 100A3 and the reference holes 100A4 are used for matching of mounting position in mounting the image reading device 300. That is, the image reading device 300 can be mounted at a proper mounting position by fitting protrusions on the image reading device 300 side into the long holes 100A3 and performing sliding in the back and forth direction of the body casing 200 to fit other protrusion into the reference hole 100A4.

The positioning structure is advantageous in that it can improve the workability of mounting the image reading device 300. The same effect can also be attained by a configuration shown in FIG. 10.

Figure 10:
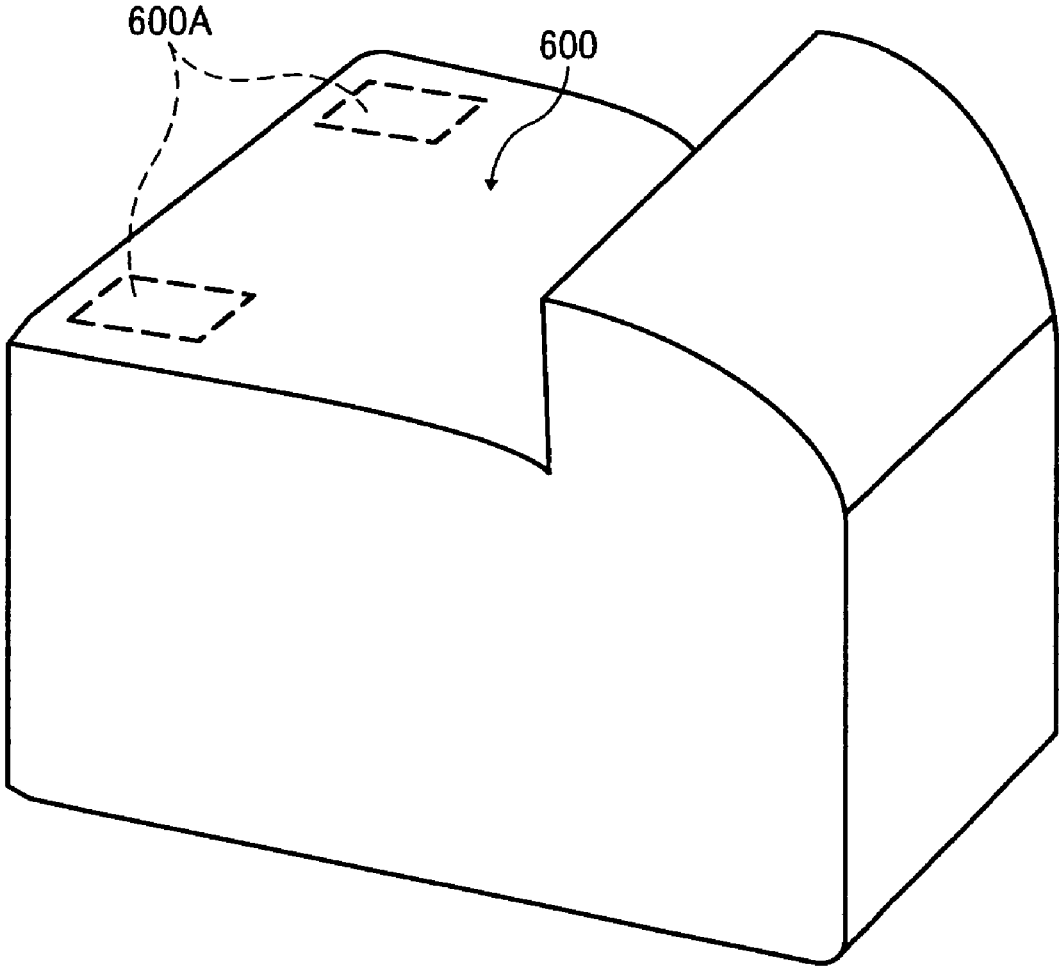
FIG. 10 is a perspective view of an outer cover of the image forming apparatus shown in FIG. 4.

FIG. 10 is a diagram for explaining a configuration when the image reading device 300 is mounted, for example, by afterward addition.

An opening/closing unit 600A is provided in an outer cover 600 provided so as to cover the body casing. The opening/closing unit 600A is provided at positions corresponding to the positions at which the positioning structure shown in FIG. 7 or 8 is provided.

For example, the opening/closing unit 600A is formed of a portion that has been subjected to perforation or the like. Upon depression of the portion, the opening/closing unit 600A is opened. Alternatively, the opening/closing unit 600A may be formed of a color display portion. When the opening/closing unit 600A is opened, the positioning unit is externally exposed. Consequently, the position at which the image reading device 300 is mounted can easily be determined.

According to the present invention, while ensuring the rigidity provided by the shape and structure of the toner feed unit, deformation of the body casing caused by the application of a load of the mounted device to the body casing as a result of direct application of the load of the mounted device can be prevented.

Furthermore, while ensuring the stability of the mounted device, a load applied from the mounted device can be dispersed, whereby deformation, which is likely to occur in the toner feed unit by load concentration, can also be prevented. Thus, the prevention of deformation of the body casing and the prevention of defective-image formation caused by the deformation of the body casing can be realized without the need to specially change the structure of the body casing as an existing structure.

Furthermore, according to the present invention, direct application of the load to the body casing can be prevented more reliably.

Furthermore, according to the present invention, an elastic body such as rubber or a cushioning material is used so that the load from the mounted device can be cushioned. Therefore, load concentration on the body casing can be prevented.

Additionally, according to the present invention, positioning of mounting position of the device to be mounted can easily be performed, and, thus, the workability of mounting can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus including a toner feed unit that feeds toner to a developing device in the image forming apparatus and arranged inside and near a top surface of a body casing of the image forming apparatus, the toner feed unit including a toner container configured to house therein toner; and a frame configured to hold the toner container, the frame including a toner-container storage portion having a curved concave portion to hold the toner container, the toner-container storage portion being formed of a material different from a material of the body casing; and a supporting surface that supports plural portions of a mounting target device that is configured to be mounted above the toner-container storage portion by surface contact.

2. The image forming apparatus according to claim 1, wherein the frame further having a side portion along each side portion of the body casing, a rear portion connecting the side portions, and a plurality of legs made of a sheet metal and configured to extend from a surface of the side portions that is located opposite to a surface on which the mounting target device is to be mounted so as to enclose the body casing.

3. The image forming apparatus according to claim 2, wherein a loading part for loading therein the toner container is provided in each of the side portions of the frame, and the side portions and the rear portions are configured as a portion that receives a bottom of the mounting target device.

4. The image forming apparatus according to claim 3, wherein the frame includes a positioning unit having an attach/detach relationship with the mounting target device.

5. The image forming apparatus according to claim 4, wherein the positioning unit includes a hole having a shape that allows the mounting target device to slid in a back and forth direction of the body casing.

6. The image forming apparatus according to claim 3, wherein outside of the frame is covered with an outer cover, an opening/closing unit is provided in a part of the outer cover in its positions corresponding to the both side portions and the rear portion, and the opening/closing unit is in a closed state when the mounting target device has not been mounted.

7. The image forming apparatus according to claim 2, wherein the frame is integrated with the body casing by fastening, and, at positions of the fastening, a cushioning material is provided between the body casing and the frame.

8. The image forming apparatus according to claim 7, wherein the frame includes a positioning unit having an attach/detach relationship with the mounting target device.

9. The image forming apparatus according to claim 8, wherein the positioning unit includes a hole having a shape that allows the mounting target device to slid in a back and forth direction of the body casing.

10. The image forming apparatus according to claim 7, wherein outside of the frame is covered with an outer cover, an opening/closing unit is provided in a part of the outer cover in its positions corresponding to the both side portions and the rear portion, and the opening/closing unit is in a closed state when the mounting target device has not been mounted.

11. The image forming apparatus according to claim 2, wherein the frame includes a positioning unit having an attach/detach relationship with the mounting target device.

12. The image forming apparatus according to claim 11, wherein the positioning unit includes a hole having a shape that allows the mounting target device to slid in a back and forth direction of the body casing.

13. The image forming apparatus according to claim 2, wherein outside of the frame is covered with an outer cover, an opening/closing unit is provided in a part of the outer cover in its positions corresponding to the both side portions and the rear portion, and the opening/closing unit is in a closed state when the mounting target device has not been mounted.

14. An image forming apparatus including a toner feed unit that feeds toner to a developing device in the image forming apparatus and arranged inside and near a top surface of a body casing of the image forming apparatus, the toner feed unit including a toner container configured to house therein toner; and a frame configured to hold the toner container, the frame including a toner-container storage portion having a curved concave portion to hold the toner container, the toner-container storage portion being formed of a material different from a material of the body casing; and a supporting surface that supports three points of a mounting target device that is configured to be mounted above the toner-container storage portion by surface contact.

15. The image forming apparatus according to claim 14, wherein the mounting target device is an image reading device.

16. An image forming apparatus including a toner feed means for feeding toner to a developing device in the image forming apparatus and arranged inside and near a top surface of a body casing of the image forming apparatus, the toner feed means including a toner container means configured to house therein toner; and a frame means configured to hold the toner container means, the frame means including a toner-container storage means having a curved concave portion to hold the toner container means, the toner-container storage means being formed of a material different from a material of the body casing; and a supporting surface means that supports plural portions of a mounting target device that is configured to be mounted above the toner-container storage means by surface contact.

* * * * *